US011013326B2

(12) United States Patent
Graber et al.

(10) Patent No.: US 11,013,326 B2
(45) Date of Patent: May 25, 2021

(54) FLOATING SHELF BRACKET WITH HEIGHT ADJUSTMENT SYSTEM

(71) Applicant: Shelf.Maid LLC, Montgomery, IN (US)

(72) Inventors: Laban Graber, Odon, IN (US); Delbert Kemp, Montgomery, IN (US)

(73) Assignee: Shelf.Maid, LLC, Montgomery, IN (US)

( * ) Notice: Subject to any disclaimer, the term of this patent is extended or adjusted under 35 U.S.C. 154(b) by 0 days.

(21) Appl. No.: 16/783,211

(22) Filed: Feb. 6, 2020

(65) Prior Publication Data

US 2020/0178688 A1 Jun. 11, 2020

Related U.S. Application Data

(63) Continuation of application No. 15/833,617, filed on Dec. 6, 2017, now Pat. No. 10,588,412.

(51) Int. Cl.

| | |
|---|---|
| ***A47B 95/00*** | (2006.01) |
| ***A47B 96/07*** | (2006.01) |
| ***A47B 96/02*** | (2006.01) |

(52) U.S. Cl.

CPC ..... *A47B 95/008* (2013.01); *A47B 96/028* (2013.01); *A47B 96/07* (2013.01)

(58) Field of Classification Search

CPC ..... A47B 95/008; A47B 57/045; A47B 57/52; A47B 57/56; A47B 96/07; A47B 96/06; A47B 96/068; A47B 96/061; A47B 96/027; A47B 96/028; A47B 96/066

USPC ..... 108/152

See application file for complete search history.

(56) References Cited

U.S. PATENT DOCUMENTS

| | | | | | |
|---|---|---|---|---|---|
| 3,029,056 | A * | 4/1962 | Breglia | A47B 96/061 | 248/243 |
| 3,437,214 | A * | 4/1969 | Sainsbury | A47B 96/067 | 211/90.04 |
| 3,527,175 | A * | 9/1970 | Kapnek | A47B 96/066 | 108/152 |
| 3,752,088 | A * | 8/1973 | Kapnek | A47B 5/02 | 108/152 |

(Continued)

FOREIGN PATENT DOCUMENTS

| | | | | |
|---|---|---|---|---|
| EP | 1844682 | A2 * | 10/2007 | A47B 96/07 |
| EP | 2881010 | A1 * | 6/2015 | F16B 12/22 |
| WO | WO-2010034467 | A1 * | 4/2010 | F16B 12/22 |

*Primary Examiner* — Patrick D Hawn

(74) *Attorney, Agent, or Firm* — Overhauser Law Offices, LLC

(57) ABSTRACT

A shelf system includes a bracket, a fastener configured to extend into a wall through the bracket, a lag bolt configured to extend into the wall and rotate within a notch defined by the bracket, and a support arm configured to extend from the bracket. The bracket and the lag bolt are configured to move the bracket relative to the wall when the lag bolt rotates within the notch. A method for setting a shelf surface angle includes movably attaching a bracket to a wall, positioning a component within a notch defined by the bracket, extending the component into the wall, and, by adjusting the extension of the component, causing the bracket to move relative to the wall until the angle is achieved. A system for setting a shelf surface angle includes a support arm and a means, attached to the support arm, for setting the angle.

6 Claims, 8 Drawing Sheets

(56) References Cited

U.S. PATENT DOCUMENTS 4,319,531 A * 3/1982 Caldwell ..... A47G 1/20 108/152
4,381,715 A * 5/1983 Forman ..... A47B 96/066 108/102
4,441,433 A * 4/1984 Caldwell ..... A47G 1/20 108/152
5,197,703 A * 3/1993 Pratolongo ..... A47B 57/04 108/152
6,164,610 A * 12/2000 Santiago ..... A47B 96/022 211/90.01
8,082,859 B2 * 12/2011 Sevack ..... A47B 96/066 108/152
9,163,415 B2 * 10/2015 Nies ..... A47B 96/061
9,185,979 B1 * 11/2015 Jenks ..... A47B 96/066
9,462,885 B2 * 10/2016 Cohen ..... A47B 5/04
9,629,457 B2 * 4/2017 Cohen ..... A47B 5/04
9,861,198 B2 * 1/2018 Anderson ..... A47B 96/066
9,988,839 B2 * 6/2018 Geiger ..... E06B 9/50
10,575,641 B1 * 3/2020 Severa ..... A47B 96/061
2007/0125738 A1 * 6/2007 Sevack ..... A47B 96/066 211/187
2008/0224004 A1 * 9/2008 Gallien ..... A47B 96/022 248/220.1
2009/0224119 A1 * 9/2009 Heffernan ..... A47B 96/066 248/225.11
2011/0155677 A1 * 6/2011 Fernandez ..... A47F 5/0869 211/86.01
2011/0315647 A1 * 12/2011 Andersson ..... A47B 96/061 211/90.01
2013/0181102 A1 * 7/2013 Tooley ..... F16B 12/00 248/205.3
2015/0366409 A1 * 12/2015 Cohen ..... A47B 5/04 4/611
2017/0202372 A1 * 7/2017 Ringel ..... A47F 11/10
2017/0215586 A1 * 8/2017 Zonneveld ..... A47B 96/066
2017/0280873 A1 * 10/2017 Anderson ..... A47B 96/066
2018/0140086 A1 * 5/2018 Witzel ..... A47B 5/02
2019/0053623 A1 * 2/2019 Sisto ..... A47B 96/06
2020/0054134 A1 * 2/2020 Severa ..... A47B 96/061

* cited by examiner

FLOATING SHELF BRACKET WITH HEIGHT ADJUSTMENT SYSTEM

This application is a continuation of U.S. application Ser. No. 15/833,617 filed Dec. 6, 2017, the disclosure of which is hereby incorporated by reference.

FIELD OF THE INVENTION

The present invention relates to a system for the installation of adjustable floating shelves.

BACKGROUND

A sagging ceiling, creaky floor, or leaning wall in a home, office building, or other structure may be the result of any number of unenviable circumstances, including but not limited to poor original architectural design, substandard original construction or substandard renovation, aging materials, severe weather, or a shifting foundation. In any event, walls of many homes, offices, and other structures are not exactly vertical. Historically, a "floating shelf" has been a type of shelf that substantially hides its support brackets within itself, to appear as though it is floating against a wall. Wikipedia, https://en.wikipedia.org/wiki/Floating_shelf. Hanging a floating shelf on a leaning wall in a way that the shelf is level notwithstanding the lean of the wall has been undesirably challenging. Relevelling such a shelf after a wall has shifted has been undesirably challenging as well.

SUMMARY OF THE INVENTION

One embodiment of the invention provides a shelf system for a wall. The system includes a wall bracket with a wall-facing surface, a shelf-facing surface, a top surface, and a bottom surface. The bottom surface defines a notch. And the wall bracket also defines a through-hole positioned above the notch. The system also includes a fastener configured to extend through the through-hole and into the wall, a lag bolt configured to extend into the wall and rotate within the notch, and a shelf support arm configured to extend from the wall bracket. The wall bracket and the lag bolt are also configured to move the wall bracket relative to the wall when the lag bolt extends into the wall and rotates within the notch.

In another embodiment, the invention provides a method for using a shelf support system to set a desired angle of a surface of a shelf relative to a wall. The method includes movably attaching the wall bracket to the wall with a first component, positioning a first portion of a second component within a notch defined by a wall bracket, extending a second portion of the second component into the wall, and causing the portion of the wall bracket that defines the notch to move relative to the wall until the desired angle is achieved. Causing the portion of the wall bracket to move includes causing the portion of the wall bracket to move by adjusting the extension of the second portion of the second component into the wall.

In yet another embodiment, the invention provides a system for setting a desired angle of a surface of a shelf relative to a wall. The system includes a shelf support arm and a means, attached to the shelf support arm, for setting the desired angle.

DETAILED DESCRIPTION

Figure 1:
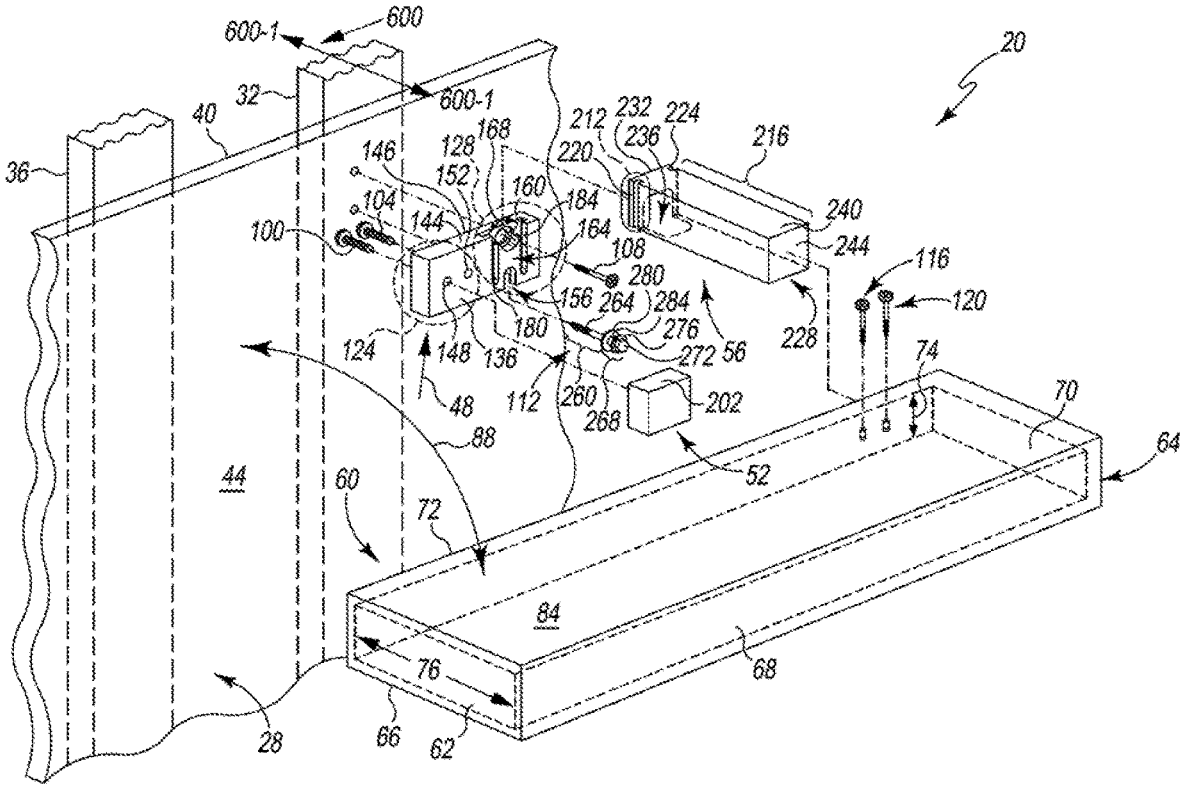
FIG. 1 shows an exploded perspective view of an exemplary floating shelf system.

Like reference numerals refer to like parts throughout the following description and the accompanying drawings.

FIG. 1 shows an exploded perspective view of an exemplary floating shelf system 20 according to the present invention, and a wall 28 including a first framing stud 32, a second framing stud 36, and a wall board 40, with wall board 40 including a shelf-facing surface 44. System 20 includes a wall bracket 48, a fixation stock 52, a shelf support arm 56, and a hollow substantially rectilinear shelf 60. Shelf 60 includes left sidewall 62, a right sidewall 64, a bottom side 66, a front wall 68, top side 70, and a wall-facing edge 72. Shelf 60 has an interior dimension 74 from bottom side 66 to top side 70, and has an interior dimension 76 front wall 68 to wall-facing edge 72. Further, shelf 60 includes a top surface 84 that is positioned to a desired angle 88 as described in further detail below. System 20 also includes a fastener 100, a fastener 104, a fastener 108, a lag bolt 112, a fastener 116, and a fastener 120.

Wall bracket 48 is fixedly attached to fixation stock 52 by fastener 100 and fastener 104, movably coupled to wall 28 by fastener 108 and lag bolt 112, and removably coupled to shelf support arm 56 as described in further detail below. Wall bracket 48 includes a left portion 124, a right portion 128, a wall-facing surface 132 (not visible in FIG. 1, but see FIG. 4), a shelf-facing surface 136, a bottom surface 140 (not visible in FIG. 1, but see FIG. 8), a top surface 144, and a top back edge 146. Left portion 124 defines a through-hole 148 that extends through left portion 124 (and through wall-facing surface 132 and shelf-facing surface 136). Left portion 124 also defines a through-hole 152 that is laterally spaced apart from through-hole 148 and also extends through left portion 124 (and through wall-facing surface 132 and shelf-facing surface 136). Meanwhile, bottom surface 140 defines a generally inverted-U-shaped notch 156 that extends between wall-facing surface 132 and shelf-facing surface 136 and that is configured to accommodate lag bolt 112 as described in further detail below, and right portion 128 of wall bracket 48 defines a through-hole 160 that is positioned above notch 156 and extends through right portion 128 (and through wall-facing surface 132 and shelf-facing surface 136). In exemplary system 20, wall bracket 48 is made from aluminum. In alternative embodiments, wall bracket 48 may be made from a suitable wood, a suitable high-density polyethylene or other plastic, or any other suitable material.

128 of wall bracket 48 also defines a generally door-frame-shaped or generally inverted-square-U-shaped recess 164. Recess 164 includes a head portion 168 that spans across 160. Recess 164 extends into a left T-channel 180 defined by right portion 128 of wall bracket 48. Left T-channel 180 is positioned to the left of 160 and to the left of notch 156, and extends downwardly from head portion 168 toward bottom surface 140 (but not all the way down to bottom surface 140). Recess 164 also extends into a right T-channel 184 defined by right portion 128 of wall bracket 48. Right T-channel 184 is positioned to the right of 160 and to the right of notch 156, and extends downwardly from head portion 168 toward bottom surface 140 (but not all the way down to bottom surface 140). In alternative embodiments, either or both of left T-channel 180 and right T-channel 184 may extend (downwardly from head portion 168) all the way through bottom surface 140. Wall-facing surface 132 (not visible in FIG. 1, but see FIG. 4) of wall bracket 48 defines a generally inverted-U-shaped recess 198 (not visible in FIG. 1, but see FIG. 4) that is configured to accommodate lag bolt 112 as described in further detail below.

Fastener 100 and fastener 104 extend through through-hole 148 and through-hole 152, respectively, to attach fixation stock 52 to wall bracket 48. In exemplary system 20, fastener 100 and fastener 104 are self-tapping screws made of steel, and fixation stock 52 is a substantially rectangular prism made of high density polyethylene. Fixation stock 52 includes a top surface 202 and a bottom surface 206 (not visible in FIG. 1, but see FIG. 8). In alternative embodiments, fixation stock 52 may be implemented in any other suitable shape and may be made from any other suitable plastic, a suitable wood, or any other suitable material, and fastener 100 and fastener 104 may be made of brass, bronze, or any other suitable material. In other alternative embodiments, fastener 100 and fastener 104 may be suitable nails, suitable rivets, suitable pegs, or any other suitable fasteners made of any suitable material. In other alternative embodiments, fastener 100 and fastener 104 may be omitted, and fixation stock 52 may be glued or clamped to wall bracket 48 instead. In yet other alternative embodiments, fixation stock 52 may be integral to wall bracket 48 rather than implemented as a separate part.

56 is configured to removably attach to wall bracket 48 and to support shelf 60, and includes a wall-plate-engagement end 212 and a shelf-support portion 216 extending from wall-plate-engagement end 212. Wall-plate-engagement end 212 includes a left T-shaped flange 220 and an opposing right T-shaped flange 224. Left T-shaped flange 220 and right T-shaped flange 224 slide into left T-channel 180 and right T-channel 184, respectively, such that shelf support arm 56 is removably attached to wall bracket 48 (and such that shelf support arm 56 may be detached from wall bracket 48 by sliding left T-shaped flange 220 and right T-shaped flange 224 out of left T-channel 180 and right T-channel 184, respectively). Shelf-support portion 216 is substantially rectilinearly prismatic and substantially hollow, and includes a bottom side 228 and a wall-plate-facing edge 232 defining a recess 236 in bottom side 228 that is configured to provide suitable access to lag bolt 112 for rotating lag bolt 112 with a wrench or other suitable tool 238 (not shown in FIG. 1, but see FIG. 8) during operation of system 20. Shelf-support portion 216 also includes a top surface 240 and a front surface 244. In exemplary system 20, shelf support arm 56 is made from aluminum. In alternative embodiments, shelf support arm 56 may be made from a suitable wood, a suitable high-density polyethylene or other plastic, or any other suitable material.

In exemplary system 20, fastener 108 is a self-tapping screw made of steel, and fastener 108 and right portion 128 (including 160) are configured to allow fastener 108 to extend through 160 and attach wall bracket 48 to stud 32. In alternative embodiments, fastener 108 may be made of brass, bronze, or any other suitable material. In other alternative embodiments, fastener 108 may be a suitable nail, suitable rivet, suitable peg, or any other suitable fastener made of any suitable material.

Lag bolt 112 is a self-tapping lag bolt made of steel, and lag bolt 112 and wall bracket 48 are configured to allow lag bolt 112 to move wall bracket 48 during operation of system 20 as described in further detail below. Lag bolt 112 includes a body shaft portion 260 having a screw-threaded end 264, and further includes head portion 268 that is fixed onto and caps body shaft portion 260 and is substantially coaxial to body shaft portion 260. Head portion 268 includes a generally hexagonally-prismatic hex portion 272 that is substantially coaxial to body shaft portion 260, a first annular flange 276 that extends from hex portion 272 and is substantially coaxial to body shaft portion 260, a second annular flange 280 that is axially spaced apart from first annular flange 276 and is substantially coaxial to body shaft portion 260, and a head shaft portion 284 that extends between first annular flange 276 and second annular flange 280 and is substantially coaxial to body shaft portion 260. As shown in FIG. 1, head shaft portion 284 is inserted into notch 156 such that head shaft portion 284 rotatably abuts bottom surface 140 (within notch 156), first annular flange 276 rotatably abuts shelf-facing surface 136, and second annular flange 280 rotatably abuts wall-facing surface 132 (within recess 198). The first annular flange 276 and second annular flange 280, each have a width greater than the width of the notch 156 such that neither annular flange 276, 280 will fit through the notch 156. Further, screw-threaded end 264 is screwed through wall 28 and into stud 32. It should be appreciated that in alternative embodiments, hex portion 272 may be replaced with a head portion suitably sized and shaped to be rotated by a "tori" type tool, such as, for example only and not limitation, a head portion configured to fit into a T30 Torx 3/s in. Drive Bit marketed by Husky (which has been sold by Home Depot). In other alternative embodiments, hex portion 272 may be replaced with a head portion suitably configured to be rotated by a Phillips-head type screwdriver tool. And in alternative embodiments, lag bolt 112 may be made of brass, bronze, or any other suitable material.

In exemplary system 20, fastener 116 and fastener 120 are self-tapping screws made of steel, and are screwed through top side 70 of shelf 60, through top surface 202 of fixation stock 52, and into fixation stock 52 to fixedly attach shelf 60 to fixation stock 52. In alternative embodiments, fastener 116 and fastener 120 may be made of brass, bronze, or any other suitable material. In other alternative embodiments, each of fastener 116 and fastener 120 may be a suitable nail, suitable rivet, suitable peg, or any other suitable fastener made of any suitable material.

Figure 2:
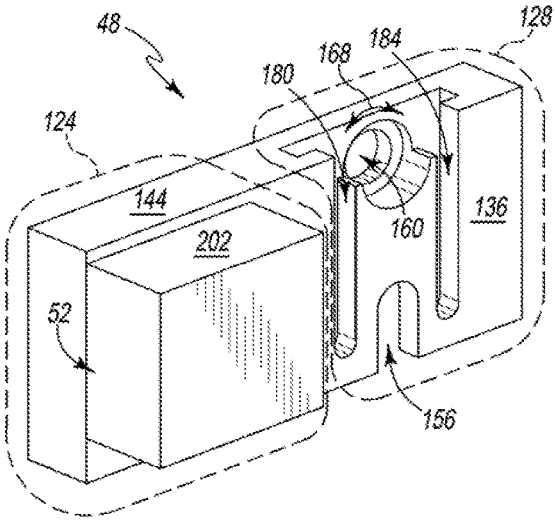
FIG. 2 shows a front top perspective view of the wall bracket and fixation stock of the exemplary system of FIG. 1.
Figure 3:
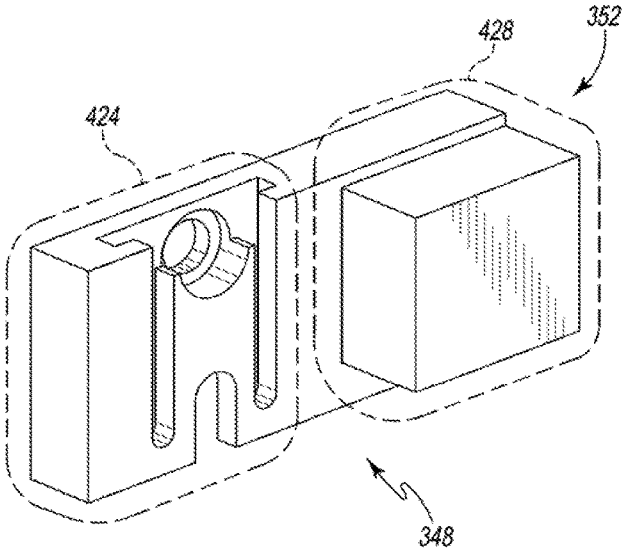
FIG. 3 shows a front top perspective view of an alternative wall bracket attached to an alternative fixation stock.

FIG. 2 shows a front top perspective view of wall bracket 48 attached to fixation stock 52. Among other things, left portion 124 of wall bracket 48, right portion 128 of wall bracket 48, shelf-facing surface 136 of wall bracket 48, top surface 144 of wall bracket 48, notch 156 of wall bracket 48, through-hole 160, left T-channel 180 of wall bracket 48, right T-channel 184 of wall bracket 48, and top surface 202 of fixation stock 52 are all at least partially discernable in FIG. 2. Meanwhile, FIG. 3 shows a front top perspective view of an alternative wall bracket 348 according to the present invention, attached to an alternative fixation stock 352 according to the present invention. As shown in FIG. 3, alternative wall bracket 348 includes a left portion 424 and a right portion 428. And as should be appreciated by comparing FIG. 2 to FIG. 3, left portion 424 of alternative wall bracket 348 is made and configured to mirror image right portion 128 of wall bracket 48, while right portion 428 of alternative wall bracket 348 is made and configured to mirror image left portion 124 of wall bracket 48, and alternative fixation stock 352 is made and configured to mirror image fixation stock 52.

Figure 5:
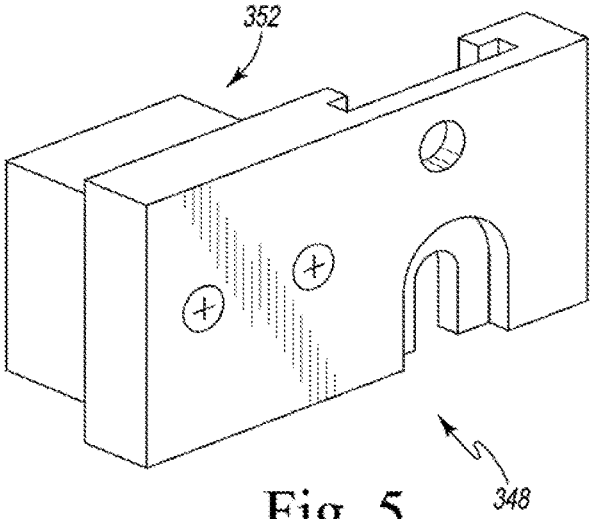
FIG. 5 shows a back top perspective view of the alternative wall bracket of FIG. 3 attached to the alternative fixation stock of FIG. 3.
Figure 4:
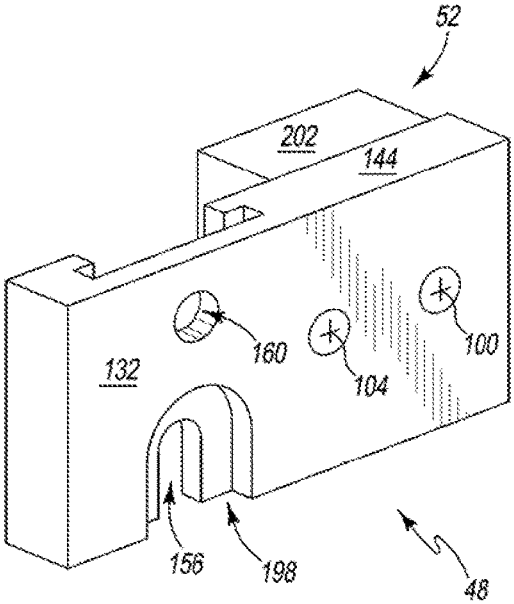
FIG. 4 shows a back top perspective view of the wall bracket of FIG. 1 attached to fixation stock of FIG. 1.

FIG. 4 shows a back top perspective view of wall bracket 48 attached to fixation stock 52. Among other things, wall-facing surface 132 of wall bracket 48, top surface 144 of wall bracket 48, notch 156, recess 198, through-hole 160, fastener 100, and fastener 104 are all at least partially discernable in FIG. 4. Meanwhile, FIG. 5 shows a back top perspective view of alternative wall bracket 348 attached to alternative fixation stock 352. As noted above, and as should be further appreciated by comparing FIG. 4 to FIG. 5, alternative wall bracket 348 is made and configured to mirror image wall bracket 48, and alternative fixation stock 352 is made and configured to mirror image fixation stock 52.

Figure 6:
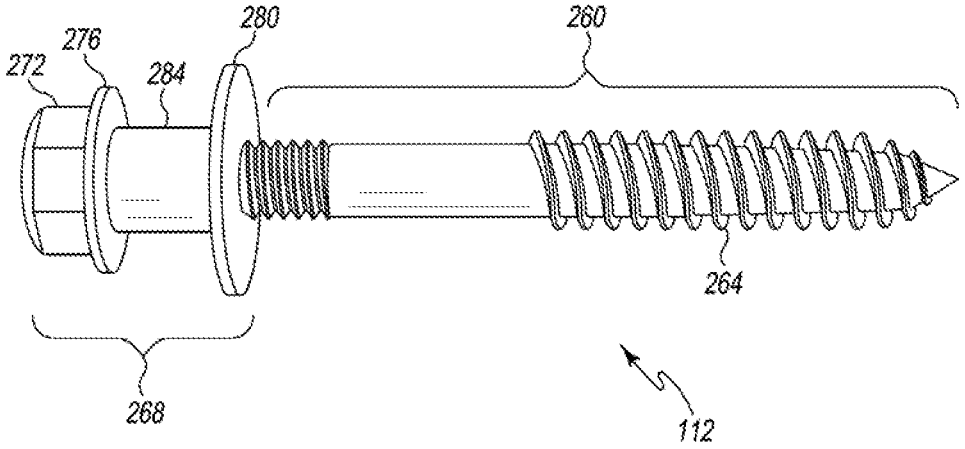
FIG. 6 shows a side plan view of the lag bolt of the exemplary system of FIG. 1.

FIG. 6 shows a side plan view of lag bolt 112. Body shaft portion 260 of lag bolt 112, screw-threaded end 264 of body shaft portion 260, head portion 268 of lag bolt 112, hex portion 272 of head portion 268, first annular flange 276 of head portion 268, second annular flange 280 of head portion 268, and head shaft portion 284 of head portion 268 are all at least partially discernable in FIG. 6.

Figure 7:
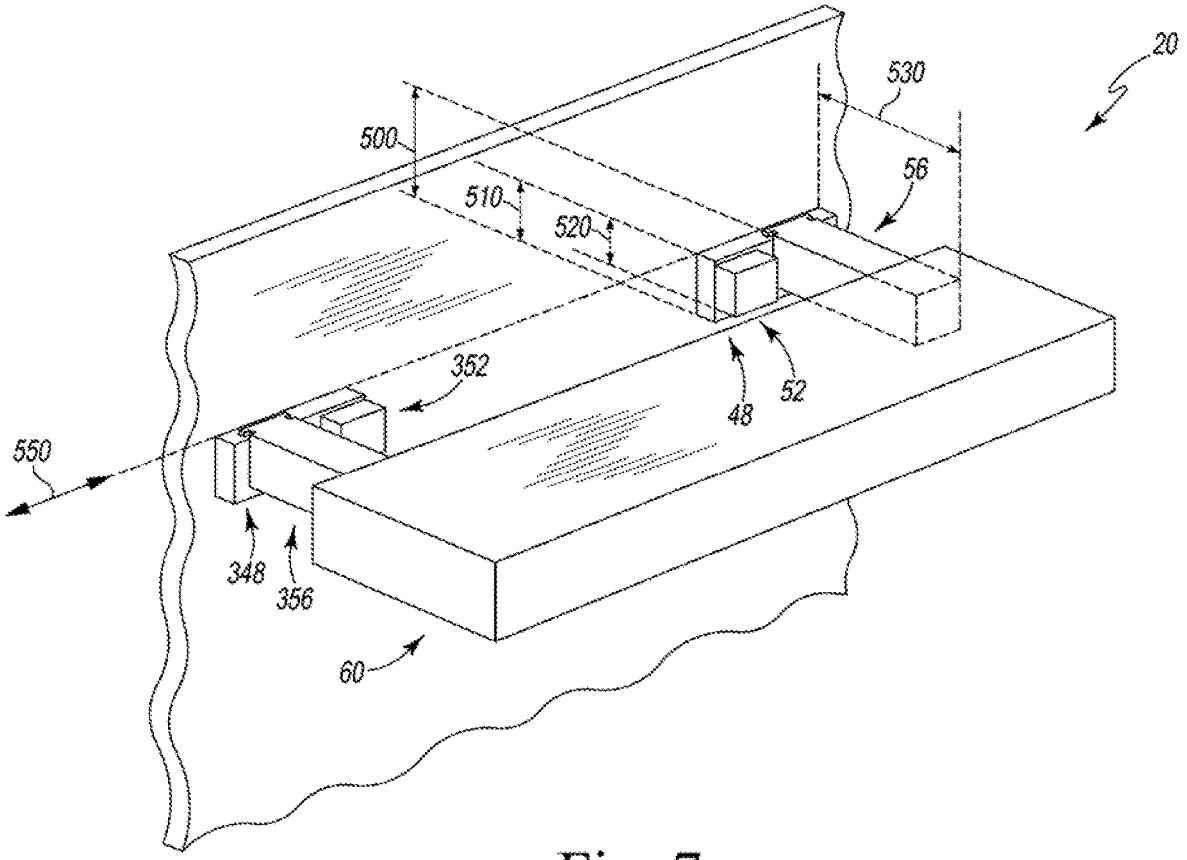
FIG. 7 shows a perspective view of the exemplary system of FIG. 1 on wall 28, along with the alternative wall bracket, the alternative fixation stock, and an alternative shelf support arm.

FIG. 7 shows a perspective view of system 20 on wall 28, along with alternative wall bracket 348, alternative fixation stock 352, and an alternative shelf support arm 356 mounted on wall 28. Alternative shelf support arm 356 is made and configured in a like manner to shelf support arm 56. When exemplary system 20 is fully assembled, shelf 60 substantially hides wall bracket 48, fixation stock 52, shelf support arm 56, alternative wall bracket 348, alternative fixation stock 352, and alternative shelf support arm 356 within shelf 60. Accordingly, as shown in FIG. 7, wall bracket 48, fixation stock 52, shelf support arm 56, and shelf 60 are also configured such that the maximum interplanar distance 500 between top surface 240 of shelf-support portion 216 of shelf support arm 56 and bottom surface 140 of wall bracket 48 is equal to or greater than the maximum interplanar distance 510 between top surface 144 of wall bracket 48 and bottom surface 140 of wall bracket 48. Further, wall bracket 48, fixation stock 52, shelf support arm 56, and shelf 60 are also configured such that maximum interplanar distance 510 is equal to or greater than the maximum interplanar distance 520 between top surface 144 of wall bracket 48 and bottom surface 206 of fixation stock 52. Further, wall bracket 48, fixation stock 52, shelf support arm 56, and shelf 60 are also configured such that interior dimension 74 of shelf 60 is equal to or greater than maximum interplanar distance 500. And wall bracket 48, fixation stock 52, shelf support arm 56, and shelf 60 are also configured such that interior dimension 76 of shelf 60 is equal to or greater than the maximum interplanar distance 530 between front surface 244 of shelf-support portion 216 of shelf support arm 56 and wall-facing surface 132 of wall bracket 48. Also, in FIG. 7, wall bracket 48 and alternative wall bracket 348 are aligned along a user-selected reference line 550.

To mount exemplary system 20 to wall 28 and adjust top surface 84 of top side 70 of shelf 60 to desired angle 88, 550 is marked on wall 28 from generally to the right of stud 32 to generally to the left of stud 36 in a well-known manner, which may include using a level, straightedge, chalk rope, and/or one or more other suitable tools to ensure that the line is desirably oriented.

Next, fastener 100 and fastener 104 are extended through 148 and through-hole 152, respectively, and fastener 100 and fastener 104 are screwed into fixation stock 52, thereby fixedly attaching fixation stock 52 to wall bracket 48.

Next, wall bracket 48 is placed against wall 28 such that top back edge 146 of wall bracket 48 is substantially aligned with the guideline (and, correspondingly, such that top surface 144 of wall bracket 48 is substantially coplanar with the guideline), and the locations of through-hole 148, through-hole 152, notch 156, and through-hole 160 are marked on wall 28.

Next, wall bracket 48 is taken away from wall 28, and suitable pilot holes are drilled through wall 28 and into stud 32 according to the previously marked locations for through-hole 148, through-hole 152, notch 156, and through-hole 160.

Next, wall bracket 48 is placed against wall 28 such that through-hole 148, through-hole 152, notch 156, and through-hole 160 align with their previously marked locations, and fastener 108 is extended through through-hole 160 and screwed through wall 28 and into stud 32, loosely attaching wall bracket 48 to wall 28. In this step, fastener 108 is not screwed so far into stud 32 that wall bracket 48 is tightly secured to wall 28.

Next, head shaft portion 284 (of head portion 268 of lag bolt 112) is inserted into notch 156, thereby rotatably abutting head shaft portion 284 to bottom surface 140 of wall bracket 48 (within notch 156), rotatably abutting first annular flange 276 (of head portion 268 of lag bolt 112) to shelf-facing surface 136 (of wall bracket 48), and rotatably abutting second annular flange 280 (of head portion 268 of lag bolt 112) to wall-facing surface 132 of wall bracket 48 (within recess 198).

Next, screw-threaded end 264 (of body shaft portion 260 of lag bolt 112) is screwed through wall 28 and into stud 32, thereby movably coupling wall bracket 48 to wall 28 such that rotating lag bolt 112 clockwise to extend screw-threaded end 264 further into wall 28 causes head portion 268 of lag bolt 112 to in turn move wall bracket 48 such that notch 156 moves closer to wall 28 while rotating lag bolt 112 counterclockwise causes head portion 268 of lag bolt 112 to in turn move wall bracket 48 such that notch 156 moves away from to wall 28.

Next, left T-shaped flange 220 and right T-shaped flange 224 of shelf support arm 56 are slid into left T-channel 180 and right T-channel 184 of wall bracket 48, respectively, thereby removably attaching shelf support arm 56 to wall bracket 48.

Next, the foregoing steps are substantially duplicated to removably couple a left, opposing shelf support arm 56 to wall 28 (and stud 36).

Next, shelf 60 is placed such that both of the opposing shelf support arm 56 extend into shelf 60 and shelf 60 rests on them, but shelf 60 is not placed so close to wall 28 that shelf 60 covers either recess 236 in either bottom side 228 of either shelf-support portion 216 of either shelf support arm 56.

Figure 8:
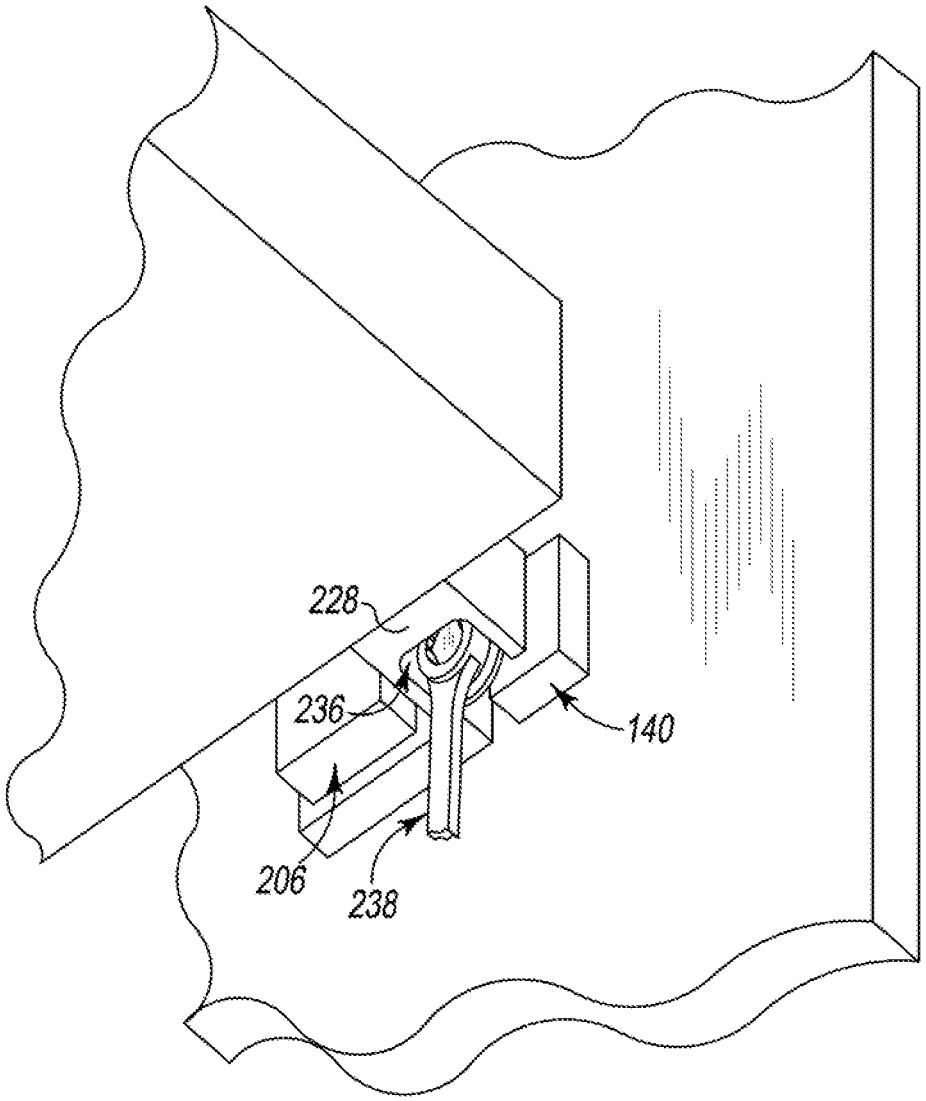
FIG. 8 shows a wrench engaging the lag bolt of the exemplary system of FIG. 1.
Figure 9:
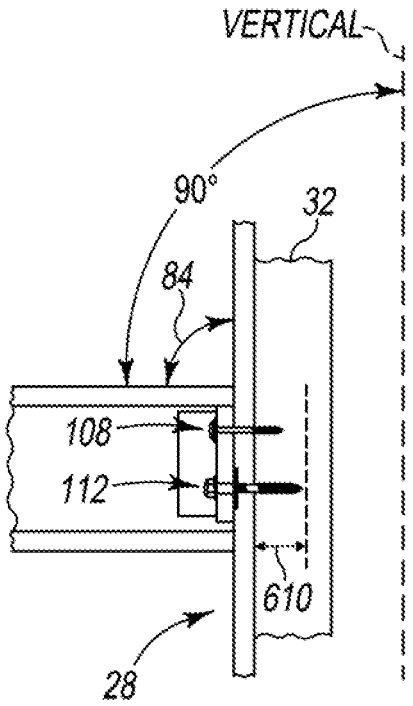
FIG. 9 is a first simplified cross-sectional view of the exemplary system of FIG. 1 (attached to a vertical wall).
Figure 10:
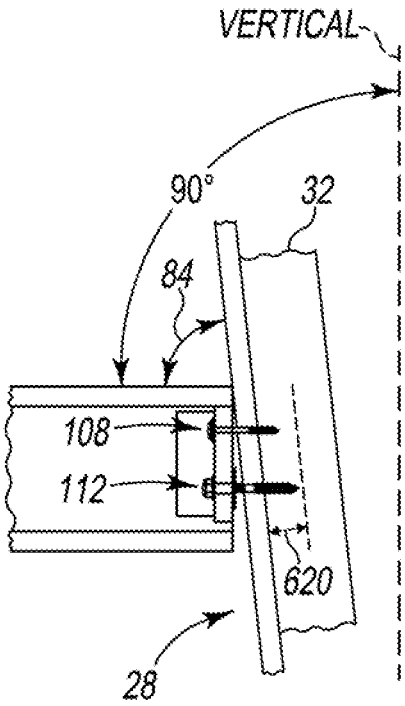
FIG. 10 is a second simplified cross-sectional view of the exemplary system of FIG. 1 (attached to a forward leaning wall).
Figure 11:
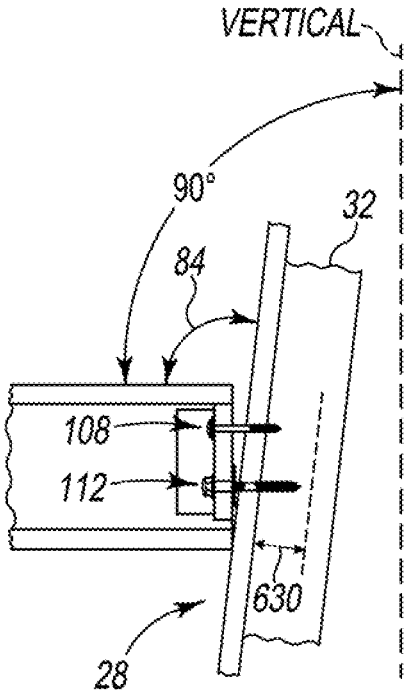
FIG. 11 is a third simplified cross-sectional view of the exemplary system of FIG. 1 (attached to a backward leaning wall).

Next, a suitable tool (see FIG. 8) is alternately inserted through each recess 236 and used to rotate each hex portion 272 (clockwise and counterclockwise, as desired), thereby adjusting top surface 84 of top side 70 of shelf 60 to desired angle 88. For example, FIG. 8 shows wrench 238 inserted through recess 236 and engaging hex portion 272 for rotating hex portion 272. Bottom surface 140 of wall bracket 48, bottom surface 206 of fixation block 52, bottom surface 228 of shelf support arm 56, and recess 236, among other things, are all at least partially discernable in FIG. 8. Further, FIG. 9 is a first simplified cross-sectional view of system 20 taken along line 600-1 of FIG. 1. FIG. 9 illustrates how, when wall 28 is vertical, fastener 108 is set in stud 32 and then lag bolt 112 is screwed flush into stud 32 to a first depth 610 to support shelf 60 such that top surface 84 of shelf 60 is oriented at 90 degrees relative to vertical. Meanwhile, FIG. 10 is a second simplified cross-sectional view of system 20 taken along line 600-1 of FIG. 1. FIG. 10 illustrates how, when wall 28 is leans forward, fastener 108 is set in stud 32 and lag bolt 112 is adjusted extend into stud 32 to a second depth 620 to support shelf 60 such that top surface 84 of shelf 60 is nevertheless oriented at 90 degrees relative to vertical. And FIG. 11 is a third simplified cross-sectional view of system 20 taken along line 600-1 of FIG. 1. FIG. 11 illustrates how, when wall 28 is leans backward, fastener 108 is set in stud 32 and lag bolt 112 is adjusted to extend into stud 32 to a third depth 630 to support shelf 60 such that top surface 84 of shelf 60 is nevertheless oriented at 90 degrees relative to vertical.

Next, shelf 60 is pushed back towards wall 28 (slides on each top surface 240 of each shelf support arm 56) until wall-facing edge 72 of shelf 60 abuts wall 28.

A pair of fastener 116 and fastener 120 are then screwed through top side 70 of shelf 60 and into one or both of opposing fixation stock 52, thereby fixedly attaching shelf 60 to fixation stock 52.

Top surface 84 of top side 70 of shelf 60 may thereafter be readjusted to desired angle 88 by simply removing the each fastener 116 and each fastener 120, sliding shelf 60 far enough away from wall 28 to expose each opposing recess 236, rotating each opposing hex portion 272, and then pushing wall-facing edge 72 of shelf 60 back into abutment with wall 28. And shelf 60 may then again be fixedly attached to fixation stock 52 by reinserting one or more of fastener 116 and fastener 120.

Figure 12:
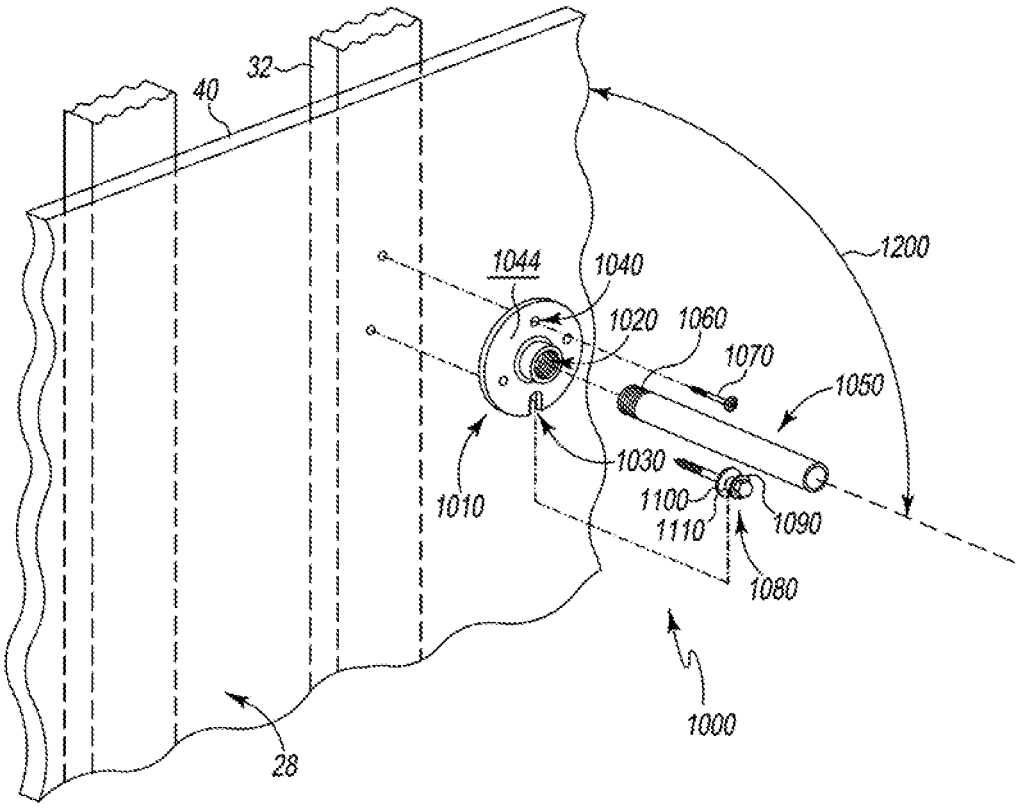
FIG. 12 shows an exploded perspective view of an exemplary alternative floating shelf system.

FIG. 12 shows an exploded perspective view of an exemplary alternative floating shelf system 1000 according to the present invention, and wall 28 (including stud 32 and wall board 40). 1000 includes a generally annular wall bracket 1010. Wall bracket 1010 defines a pipe-threaded through-hole 1020, a generally inverted-U-shaped bottom notch 1030, and a top through-hole 1040. Further, wall bracket 1010 includes a shelf-facing surface 1044 and an opposing wall-facing surface (not shown). In exemplary 1000, wall bracket 1010 is made from iron and is a suitably modified VPC ¾ in. Black Malleable Iron FPT Floor Flange, which has been marketed online by Home Depot under Model #16-521-604. In alternative embodiments, wall bracket 1010 may be made from aluminum or any other suitable material. Alternative system 1000 further includes a pipe 1050 having a pipe-threaded end portion 1060 that is screwed into through-hole 1020 of wall bracket 1010. In exemplary system 1000, pipe 1050 is made of iron, and in a well-known manner. In alternative embodiments, wall bracket 1010 may be made from aluminum or any other suitable material. System 1000 further includes a fastener 1070 that extends through through-hole 1040, through wall board 40, and into stud 32. Fastener 1070 is made and configured in a like manner to fastener 100 (described above). System 1000 further includes a lag bolt 1080. Lag bolt 1080 is made and configured in a like manner to lag bolt 112 (described above), and includes a first annular flange 1090 that rotatably abuts shelf-facing surface 1044 of wall bracket 1010, a second annular flange 1100 that rotatably abuts the wall facing surface (not shown) of wall bracket 1010, and a shaft portion 1110 that extends between first annular flange 1090 and second annular flange 1100 and is positioned in notch 1030 so as to also rotatably abut wall bracket 1010 within notch 1030. Further, lag bolt 1080 is adjustably screwed through wall board 40, and into stud 32. In operation, a shelf (not shown in FIG. 12) is supported by pipe 1050 and lag bolt 1080 is rotated (clockwise and counterclockwise, as desired) to adjust an angle 1200 between pipe 1050 and wall 28, thereby adjusting a corresponding angle of the shelf (not shown) relative to wall 28.

Those of skill in the art will understand that various details of the invention may be changed without departing from the spirit and scope of the invention. Furthermore, the foregoing description is for illustration only, and not for the purpose of limitation, the invention being defined by the claims. For example, it should be appreciated that although exemplary shelf 60 is substantially rectilinear, alternative embodiments of the present invention may incorporate or be used with practically any kind of shelf (floating or not) that can rest on suitable shelf support arms, including a shelf having an uneven interior space or an uneven top surface, such as a piece of natural wood or an irregular piece of barn siding that may be used as a shelf or mantle. It should also be appreciated that although exemplary shelf support arm 56 and exemplary pipe 1050 are substantially elongated, in alternative embodiments suitable shelf support arms may be substantially curvy, zig-zaggy, or extend in any other manner that suitably supports a shelf.

While the invention has been illustrated and described in detail in the foregoing drawings and description, the same is to be considered as illustrative and not restrictive in character, it being understood that only illustrative embodiments thereof have been show and described and that all changes and modifications that are within the scope of the following claims are desired to be protected.

All references cited in this specification are incorporated herein by reference to the extent that they supplement, explain, provide a background for or teach methodology or techniques employed herein.

What is claimed is:

1. A method for using a shelf support system to set a desired angle of a surface of a shelf relative to a wall, comprising:

providing the shelf support system including a first bolt, a second bolt having a head portion, a first annular flange having a width, a second annular flange having a width, a head shaft portion intermediate the first and second annular flanges, a body shaft portion opposite the head portion, a wall bracket having a portion defining a notch, the notch having a width less than the widths of the first and second annular flanges, and a shelf support arm, the method comprising the steps of:

movably attaching the wall bracket to the wall with the first bolt, such that the wall bracket is moveable in relation to the wall;

positioning the head shaft portion of the second bolt within the notch;

extending the body shaft portion of the second bolt into the wall; and after completing the attaching, positioning, and extending steps, adjusting the amount that the body shaft portion of the second bolt extends into the wall, causing the portion of the wall bracket that defines the notch to move relative to the wall until the desired angle is achieved.

2. The method of claim 1, wherein movably attaching the wall bracket to the wall includes loosely screwing the wall bracket to the wall, positioning the head shaft portion of the second bolt within the notch, extending the body shaft portion of the second bolt into the wall, and adjusting the amount of the body shaft portion of the second bolt that extends into the wall by rotating the head portion of the second bolt.

3. The method of claim 2, further comprising the step of: attaching the shelf support arm to the wall bracket.

4. The method of claim 3, wherein attaching the shelf support arm to the wall bracket includes inserting a flange into a T-channel.

5. The method of claim 3, further comprising the step of: resting at least a portion of the shelf on the shelf support arm.

6. The method of claim 5, wherein the step of resting at least a portion of the shelf on the shelf support arm includes substantially hiding the wall bracket and the shelf support arm within the shelf.

* * * * *